US006656293B2

(12) United States Patent
Black et al.

(10) Patent No.: US 6,656,293 B2
(45) Date of Patent: Dec. 2, 2003

(54) SURFACE TREATMENT FOR FERROUS COMPONENTS

(75) Inventors: Jared A Black, Peoria, IL (US); Matthew Thomas Kiser, Chillicothe, IL (US); Gary Leroy Biltgen, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 1 day.

(21) Appl. No.: 10/006,207

(22) Filed: Dec. 10, 2001

(65) Prior Publication Data

US 2003/0106617 A1 Jun. 12, 2003

(51) Int. Cl.[7] ..... C23C 8/00; C23C 8/80; B62D 55/205; B62D 55/215

(52) U.S. Cl. ..... 148/219; 148/218; 148/319; 305/41; 384/276

(58) Field of Search ..... 148/218, 219, 148/319; 305/41; 384/276

(56) References Cited

U.S. PATENT DOCUMENTS 4,491,500 A * 1/1985 Michaud et al. ..... 156/628
4,531,985 A 7/1985 Tommis
5,102,476 A 4/1992 Wahl
5,158,629 A * 10/1992 Zobbi ..... 156/628
5,228,929 A 7/1993 Panasiuk et al.
H1512 H 1/1996 Cowan et al.
5,549,086 A * 8/1996 Ozawa et al. ..... 123/193.6
5,709,907 A * 1/1998 Battaglia et al. ..... 427/126.1

OTHER PUBLICATIONS

"REM® Isotropic Finishing", http://www.taylor–race.com/isotropic.htm, ©2000–2001.*
"The Formula Ford Underground Archives", http://pub138.ezboard.com/fformulaforundergroundrules-discussion.showMessage?topicID=156.topic, Mar. 21, 2001.*

* cited by examiner

*Primary Examiner*—Roy King
*Assistant Examiner*—Harry D. Wilkins, III
(74) *Attorney, Agent, or Firm*—Finnegan, Henderson, Farabow, Garrett & Dunner

(57) ABSTRACT

A method for treating a surface of a first component wherein at least a portion of the surface of the first component contacts a surface of a second component. The method includes forming a compound layer at at least a portion of the surface of the first component by a thermochemical diffusion treatment and isotropically finishing the at least a portion of the surface of the first component that contacts the surface of the second component.

21 Claims, 3 Drawing Sheets

SURFACE TREATMENT FOR FERROUS COMPONENTS

TECHNICAL FIELD

The invention relates generally to surface treatment and, more particularly, to methods for providing corrosion and abrasion resistance to a surface of a ferrous material.

BACKGROUND

Many of today's earthmoving, agricultural, recreational, and military machines use tracks for propulsion. The track typically includes numerous track links chained together, each track link having metal or rubber pads that contact and grip the ground. Adjacent track links are generally joined to one another at track joints by bushing assemblies. A bushing is inserted between a pin and a bore on the track link through which the bushing passes. As the tracked machine moves, the track links move around a portion of a sprocket wheel as the individual links rotate around the pin and bushing. To resist fracture under stress and withstand impact, the bushing is typically made from a plain carbon or medium alloy steel.

Oil or grease is typically used as a lubricant in the bushing assembly. The oil may be confined by a polymeric seal located between the end surface of the bushing and the inner surface of the track link bore. Because the polymeric seal slides against a portion of the end surface of the bushing as the track moves, the end surface of the bushing contacting the polymeric seal is typically ground and polished to provide a smooth sealing surface against which the polymeric seal can slide. The ground sealing surface, however, still abrades the polymeric seal. Furthermore, the track operates in a corrosive and abrasive environment that can exacerbate grooving of the end surface of the bushing and polymeric seal. Grooving can result in oil leakage and subsequent seizing and failure of the track.

Surface treatment by thermochemical diffusion processes are known to impart abrasion resistance to the surface of steels, for example, plain carbon or medium alloy steels, without affecting the tougher, impact-resistant underlying material. In particular, nitrocarburization processes, such as disclosed in U.S. Pat. No. 5,102,476, are known to provide increased wear and corrosion resistance to steel surfaces. The disclosed nitrocarburization process introduces nitrogen and carbon into the surface of steels to produce a "white" or "compound" layer. The compound layer, depending on the steel alloy and the diffusion atmosphere, contains varying amounts of $\gamma'$ ($Fe_4N$), $\epsilon$ ($Fe_{2-3}N$), cementite, carbides, and nitrides. Similarly, nitriding introduces nitrogen into the surface of steel to form a hardened, abrasion resistant layer.

While the nitrocarburized or nitrided layer provides some corrosion and wear resistance, its surface still abrades the polymeric seal thereby allowing abrasives and corrosives to get between the polymeric seal and the end surface of the bushing to cause further grooving. Grinding of the nitrocarburized or nitrided layer is generally avoided to prevent damage of the compound layer.

Thus, there is a need to overcome these and other problems of the prior art and to provide a surface and a method for treating a surface that avoids grooving. The present invention, as illustrated in the following description, is directed to solving one or more of the problems set forth above.

SUMMARY OF THE INVENTION

In accordance with one aspect of the present invention, a method is provided for treating a surface of a first component, wherein at least a portion of the surface of the first component contacts a surface of a second component. The method includes forming a compound layer at the at least a portion of the surface of the first component by a thermochemical diffusion treatment and isotropically finishing the at least a portion of the surface of the first component that contacts the surface of the second component.

In accordance with another aspect of the present invention, a method is provided for treating a surface of a track bushing wherein at least a portion of the surface of the track bushing contacts a polymeric component to form a seal. The method includes subjecting the surface of the track bushing to a thermochemical diffusion treatment to form a compound layer and isotropically finishing at least the portion of the surface of the track bushing that contacts the polymeric component to a surface roughness of $Ra \leqq 0.1\ \mu m$.

In accordance with another aspect of the present invention, a track bushing is disclosed. The track bushing includes a surface, wherein at least a portion of the surface is isotropically finished and includes a compound layer.

In accordance with yet another aspect of the present invention, a track is disclosed. The track includes a plurality of track links, each of the plurality of track links including a bore at a first end and a second end. The track further includes a plurality of bushing assemblies, wherein the plurality of bushing assemblies join adjacent track links by residing in the bore at the second end of a first track link and the bore at the first end of a second track link. Each of the plurality of bushing assemblies includes a steel bushing having an isotropically finished surface, wherein the isotropically finished surface includes a compound layer and a pin that fits in the steel bushing. The track further includes polymeric seals that contact the isotropically finished surface of the steel bushing and an inside surface of the bore of at least one of the adjacent track links.

DETAILED DESCRIPTION

In the following description, reference is made to the accompanying drawings that form a part thereof, and in which is shown by way of illustration a specific exemplary embodiment in which the invention may be practiced. This embodiment is described in sufficient detail to enable those skilled in the art to practice the invention and it is to be understood that other embodiments may be utilized and that changes may be made without departing from the scope of the present invention. The following description is, therefore, not to be taken in a limited sense.

Figure 1A:
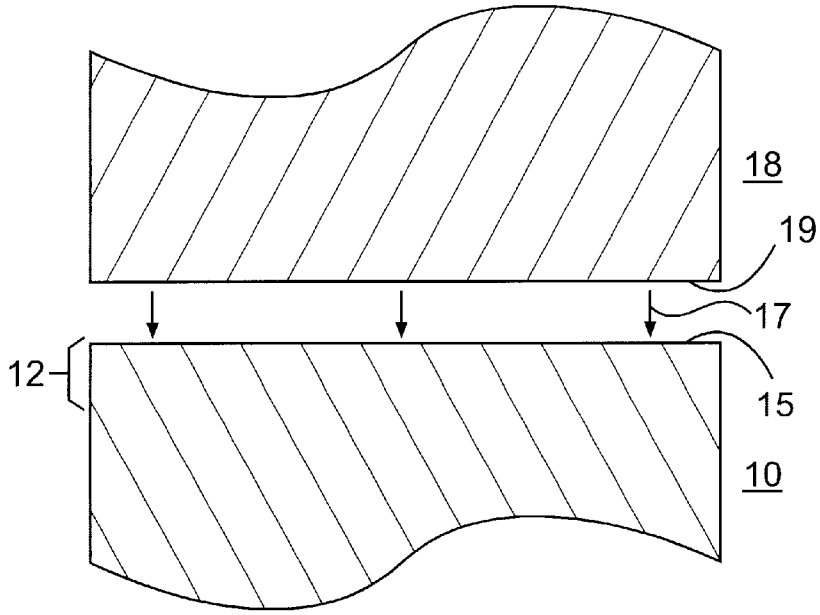
FIG. 1A is a diagrammatic cross-section of a portion of a first component having a surface that contacts a surface of a second component.
Figure 1B:
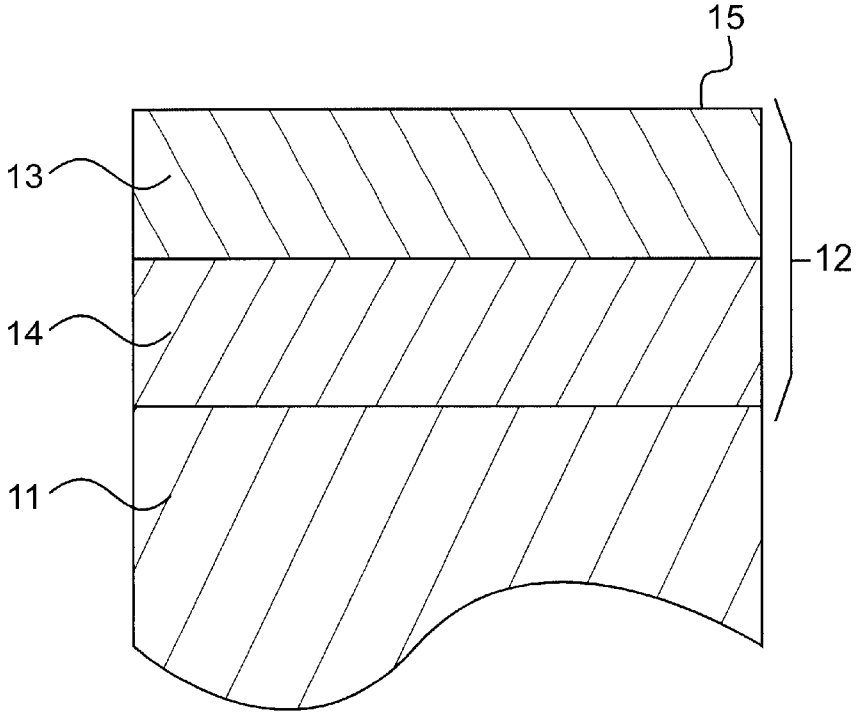
FIG. 1B is a diagrammatic cross-section of a portion of a first component including a compound layer and a diffusion layer in accordance with an exemplary embodiment of the invention.

With reference to FIGS. 1A and 1B, a method for treating a surface of a first component, wherein at least a portion of the surface of the first component contacts a surface of a second component, in accordance with an exemplary embodiment of the present invention is disclosed. FIG. 1A depicts a portion of first component 10 having surface 15 and surface region 12 and a portion of second component 18 having surface 19. In operation, surface 15 contacts surface 19, as shown by, for example, arrows 17. First component 10 includes a ferrous material. As used herein, the term "ferrous" means a metallic material having iron as a principal component, including, but not limited to, steels. FIG. 1B depicts surface region 12 including surface 15, compound layer 13 over diffusion layer 14, and core 11 underlying diffusion layer 14. The microstructural composition of compound layer 13 and the thickness of the layers depends on several factors including the composition of the core material, the type of thermochemical treatment, and the parameters of the thermochemical treatment.

In one exemplary embodiment consistent with the present invention, compound layer 13 and diffusion layer 14 are formed by a ferritic nitrocarburization treatment. The ferritic nitrocarburization treatment diffuses nitrogen and carbon into the surface of the fererous material at temperatures completely within a ferritic phase field. The parameters for ferritic nitrocarburizing a ferrous surface in a salt bath, a furnace, and a fluidized bed are known to those of skill in the art. Ferritic nitrocarburization generally results in compound layer 13 containing varying amounts of $\gamma'$ ($Fe_4N$) and $\epsilon$ ($Fe_{2-3}N$) microstructures, as well as cementite and various carbides and nitrides. Diffusion layer 14 generally has the microstructure of core 11 including nitrogen in solid solution and as metal nitride ($n_xN$) precipitates.

In another exemplary embodiment consistent with the present invention, compound layer 13 and diffusion layer 14 are formed by nitriding. Nitriding is a thermochemical diffusion treatment that diffuses nitrogen into the surface of a ferrous material without changing the microstructure of the material. The parameters for forming a compound layer and a diffusion layer by gas, liquid, and plasma nitriding are known to those of skill in the art. Nitriding generally results in compound layer 13 containing predominantly $\gamma'$ ($Fe_4N$) or predominantly $\epsilon$ ($Fe_{2-3}N$), or a mixture of $\gamma'$ and $\epsilon$ microstructures. Other thermochemical diffusion treatments to provide compound and diffusion layers are known to those with skill in the art and include, but are not limited to, ion nitriding, carburizing, boronizing, and carbonitriding.

After compound layer 13 is formed, surface 15, the portion of first component 10 that contacts surface 19 of second component 18, is subject to an isotropic finishing process. Isotropic finishing reduces the roughness of surface 15 to $Ra \leqq 0.1$ $\mu$m without removing the compound layer. Isotropic finishing can be used to further reduce the roughness of surface 15 to $Ra \leqq 0.05$ $\mu$m. The parameters for isotropic finishing are known by those with skill in the art.

Figure 2A:
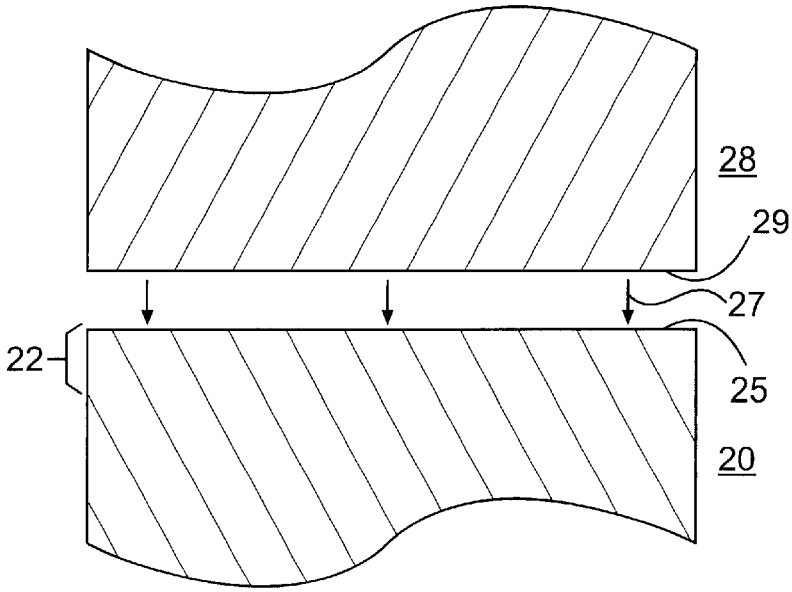
FIG. 2A is a diagrammatic cross-section of a portion of a first component having a surface that contacts a surface of a second component.
Figure 2B:
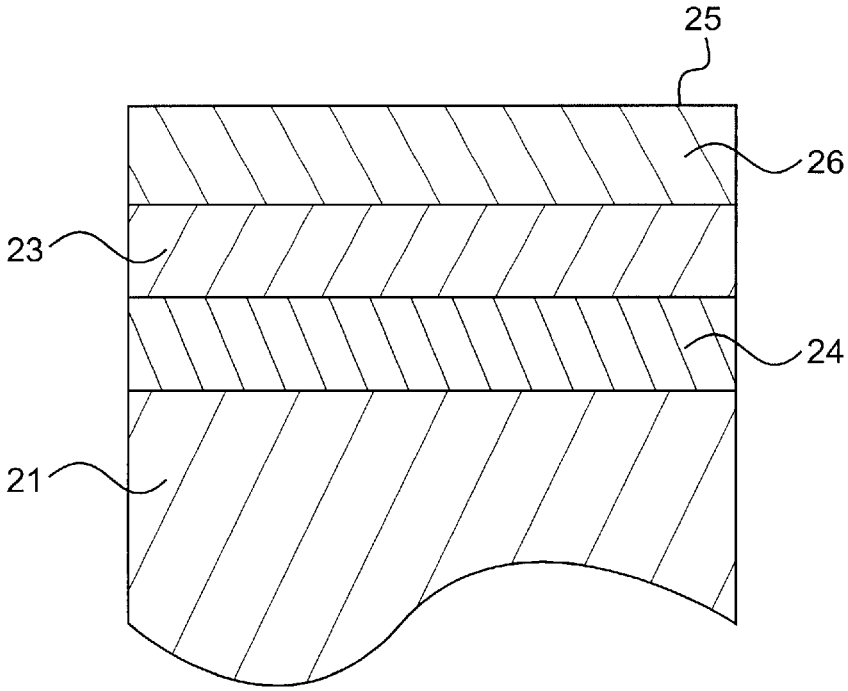
FIG. 2B is a diagrammatic cross-section of a portion of a first component including a compound layer, diffusion layer, and a physical vapor deposition layer in accordance with an exemplary embodiment of the invention.

With reference to FIGS. 2A and 2B, a method for treating a surface of a first component, wherein at least a portion of the surface of the first component contacts a surface of a second component surface, in accordance with another exemplary embodiment of the present invention is disclosed. FIG. 2A depicts a portion of first component 20 having surface 25 and surface region 22 and a portion of second component 28 having surface 29. In operation, surface 25 contacts surface 29, as shown by, for example, arrows 27. First component 20 includes a ferrous material. A thermochemical diffusion treatment is used to form compound layer 23 at surface region 22 and diffusion layer 24 underlying compound layer 23. Core 21 underlies diffusion layer 24. As discussed above, the parameters for the thermochemical diffusion treatment of ferrous surfaces, such as, for example, nitriding and ferritic nitrocarburization, are known by those with skill in the art.

After formation of compound layer 23, surface 25 of first component 20 is subject to an isotropic finishing process. Isotropic finishing reduces the roughness of surface 25 to $Ra \leqq 0.1$ $\mu$m without removing the compound layer. Isotropic finishing can be used to further reduce the roughness of surface 25 to $Ra \leqq 0.05$ $\mu$m. As discussed above, parameters for isotropic finishing are known by those with skill in the art.

Physical vapor deposition ("PVD") layer 26 is then deposited over the isotropically finished compound layer 23. PVD layer 26 can be formed by processes that deposit thin films in the gas phase in which the deposition material is physically transferred to compound layer 23 without chemical reaction, including, but not limited to, sputtering, electron beam, laser, vacuum evaporation, ion-beam-assisted, arc vapor, ion plating, thermal evaporation, and ion assisted deposition processes. The type of PVD layer 26 deposited by these processes include, but is not limited to, chrome nitride, metal containing diamond-like carbon, amorphous diamond-like carbon, TiCN, and TiBN.

Figure 3:
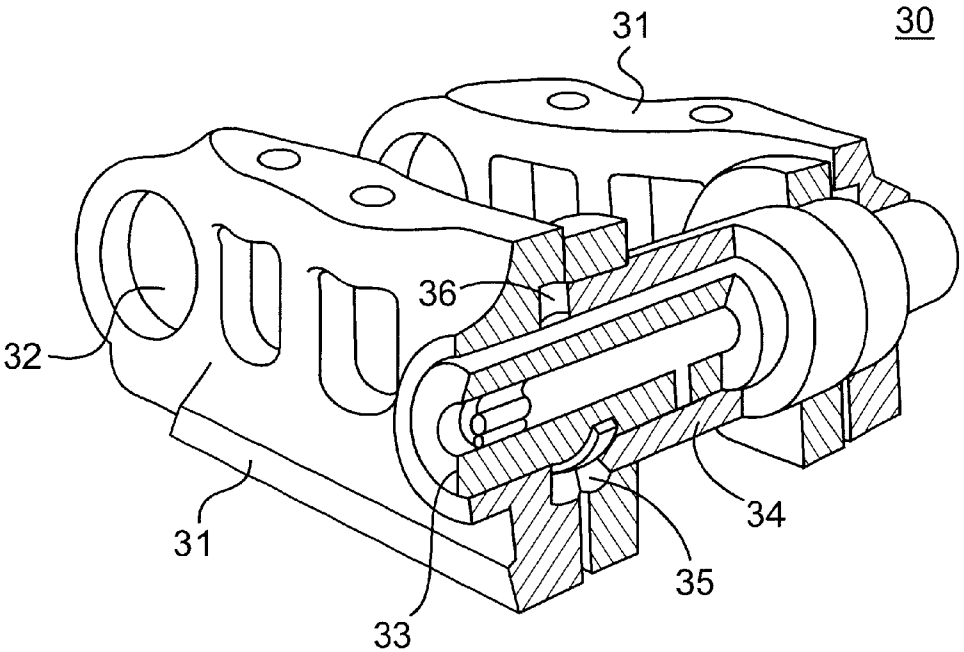
FIG. 3 is a perspective partial cut-away view of a portion of a track including a bushing assembly and track links in accordance with an exemplary embodiment of the invention.

With reference to FIG. 3, an example of surface treatment of an end surface of a track bushing in accordance with an exemplary embodiment of the present invention is provided. A portion of a track, generally designated by the reference numeral 30, includes track links 31 having bore 32 at each end thereof. Adjacent track links are joined together by bushing assemblies that include pin 33, seal 35, and bushing 34 having end face 36. In operation, seal 35 slides against end face 36 of bushing 34 as track 30 moves.

Bushing 34 may be any medium carbon steel or medium carbon low alloy steel. Bushing 34 may be, for example, made of an austenitized and direct hardened steel alloy having a composition of 0.26–0.31 wt % C, 0.50–0.70 wt % Mn, a maximum of 0.015 wt % P, a maximum of 0.010 wt % S, 1.45–1.80 wt % Si, 1.60–2.00 wt % Cr, 0.30–0.40 wt % Mo, 0.70–0.12 wt % V, 0.010–0.025 wt % Al, 0.03–0.05 wt % Ti, 0.005–0.013, and the balance Fe. Other steels suitable for bushing 34 include, but are not limited to, compositions including 0.38–0.43 wt % C, 0.75–1.00 wt % Mn, 0.035 wt % maximum of P, 0.040 wt % maximum of S, 0.15–0.35 wt % Si, 0.80–1.10 wt % Cr, 0.15–0.25 wt % Mo, and the balance Fe, and compositions including 0.28–0.33 wt % C, 0.90–1.20 wt % Mn, 0.035 wt % maximum of P, 0.050–0.080 wt % S, 0.15–0.35 wt % Si, 0.90–1.20 wt % Cr, 0.05–0.10 wt % V, 0.08–0.13 wt % Al, and the balance Fe.

Bushing 34 may be subject to a ferritic nitrocarburization treatment that includes an initial etch with phosphoric acid. As an alternative, nitric acid can be used for this etch. Bushing 34 can then be placed into an integral quench furnace at a temperature of about 570° C. An endothermic gas of 40% $H_2$, 40% $N_2$, and 20% CO may flow into the integral quench furnace at about 160 cubic feet per hour ("cfh") to serve as a carrier gas for ammonia. Ammonia gas may flow into the integral quench furnace at about 200 cfh and air may flow into the integral quench furnace at about 400 cfh. After approximately 3 hours, bushing 34 may be removed from the integral quench furnace and quenched in oil. The resultant compound layer will be approximately 5–30 $\mu$m and include $\gamma'$ ($Fe_4N$) and $\epsilon$ ($Fe_{2-3}$ N) microstructures.

End face 36 of bushing 34 may then be isotropically finished. Bushing 34 may be placed into a part container of a vibratory bath. In an initial cut stage, an abrasive may include ceramic media about 25 mm square and 8 mm thick in an acidic bath of a dilute oxalic acid solution, such as, for example, Feromill 575 made by REM Chemical. Bushing 34 may remain in the cut stage for approximately 5 minutes. A subsequent burnishing stage may use similar ceramic media and a potassium phosphate solution, such as, for example, Feromill FBC 295. Bushing 34 may remain in the burnishing stage for approximately 5 minutes. After removal from the vibratory bath, the surface roughness (Ra) of end face 36 will be about 0.05 $\mu$m or less.

With further reference to FIG. 3, an example of surface treatment of an end surface of a track bushing in accordance with another exemplary embodiment of the present invention is provided. Bushing 34, including end face 36, may be subject to a ferritic nitrocarburization treatment, such as, for example, a Trinide® process. Alternatively, the ferritic nitrocarburization treatment can include, for example, placing bushing 34 into a furnace at a temperature of about 565° C. and an atmosphere of about 500 cfh of Nx (endothermic) gas. An exothermic gas, nominally about 11% CO and 13% $H_2$ with the balance $N_2$ and $CO_2$, may be used with an ammonia flow of about 350 cfh. Bushing 34 may be held in the furnace for about 330 minutes, whereupon the ammonia flow may be stopped. Bushing 34 may be held for about an additional 30 minutes before being removed from the furnace and quenched in oil.

End face 36 of bushing 34 may then be isotropically finished to a surface roughness Ra$\leqq$0.05 $\mu$m or less as described above. A chrome nitride PVD coating may then be deposited on the isotropically finished, ferritic nitrocarburized end face 36. The chrome nitride coating can be about 2–6 $\mu$m thick.

INDUSTRIAL APPLICABILITY

The disclosed methods provide surface treatments for ferrous components. Although the methods have wide application to surface treat most ferrous materials, the present invention is particularly applicable to providing corrosion and abrasion resistant layers on plain carbon and medium alloy steels that serve as sealing surfaces. Plain carbon and medium alloy steels are typically used because of their toughness and impact resistance. A thermochemical diffusion layer provides a corrosion and abrasion resistant layer on these materials without affecting the impact resistance of the underlying steel, but the surface roughness of the layer, even after grinding, is difficult to seal against. The present invention provides a method that preserves the corrosion and abrasion resistant layer on the impact resistant underlying steel while further treating the surface to permit sealing, for example, by a polymeric seal. The method accomplishes this by use of a thermochemical diffusion process coupled with an isotropic finishing process that avoids the problems associated with other surface treatments, such as, grinding.

While the present invention has applicability in a number of fields, it is known to provide a surface with improved sealability in track joints of a tracked machine. This provides improved performance and lower warranty and repair costs.

It will be readily apparent to those skilled in this art that various changes and modifications of an obvious nature may be made, and all such changes and modifications are considered to fall within the scope of the appended claims. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method for treating a surface of a first component, wherein at least a portion of the surface of the first component contacts a surface of a second component comprising:

forming a compound layer at at least a portion of the surface of the first component by a thermochemical diffusion treatment; and isotropically finishing the at least a portion of the surface of the first component that contacts the surface of the second component.

2. The method of claim 1, wherein the thermochemical diffusion treatment is at least one of nitriding and ferritic nitrocarburizing.

3. The method of claim 1, wherein the isotropic finishing provides a surface roughness of Ra$\leqq$0.1 $\mu$m.

4. The method of claim 1, wherein the isotropic finishing provides a surface roughness of Ra$\leqq$0.05 $\mu$m.

5. The method of claim 1, further including providing a physical vapor deposition layer on the isotropically finished portion of the surface of the first component.

6. The method of claim 5, wherein the physical vapor deposition layer is formed by at least one of sputtering, electron beam deposition, laser deposition, vacuum evaporation, ion-beam-assisted deposition, arc vapor deposition, ion plating, thermal evaporation, and ion assisted deposition.

7. A method for treating a surface of a track bushing, wherein at least a portion of the surface of the track bushing contacts a polymeric component to form a seal, the method comprising:

subjecting the surface of the track bushing to a thermochemical diffusion treatment to form a compound layer; and isotropically finishing at least the portion of the surface of the track bushing that contacts the polymeric component to a surface roughness of Ra$\leqq$0.1 $\mu$m.

8. The method of claim 7, wherein the thermochemical diffusion treatment is at least one of nitriding and ferritic nitrocarburizing.

9. The method of claim 7, further including providing a physical vapor deposition layer on the isotropically finished portion of the surface of the track bushing.

10. The method of claim 9, wherein the physical vapor deposition coating is formed by at least one of sputtering, electron beam deposition, laser deposition, vacuum evaporation, ion-beam-assisted deposition, arc vapor deposition, ion plating, thermal evaporation, and ion assisted deposition.

11. A track bushing comprising a surface, wherein at least a portion of the surface is isotropically finished and includes a compound layer.

12. The track bushing of claim 11, wherein the compound layer includes at least one of $\gamma'$ ($Fe_4N$) and $\epsilon$ ($Fe_{2\text{-}3}$ N) microstructures.

13. The track bushing of claim 11, wherein the portion of the surface that is isotropically finished has a surface roughness of Ra$\leqq$0.1 $\mu$m.

14. The track bushing of claim 11, wherein the portion of the surface that is isotropically finished has a surface roughness of Ra$\leqq$0.05 $\mu$m or less.

15. The track bushing of claim 11, wherein the portion of the surface that is isotropically finished further includes a physical vapor deposition layer on the compound layer.

16. The track bushing of claim 15, wherein the physical vapor deposition layer is at least one of chrome nitride, metal containing diamond-like carbon, amorphous diamond-like carbon, TiCN, and TiBN.

17. A track comprising:

a plurality of track links, each of the plurality of track links including a bore at a first end and a second end;

a plurality of bushing assemblies, wherein the plurality of bushing assemblies join adjacent track links by residing in the bore at the second end of a first track link and the bore at the first end of a second track link, and wherein each of the plurality of bushing assemblies includes, a steel bushing having an isotropically finished surface, wherein the isotropically finished surface includes a compound layer, and a pin that fits in the steel bushing; and polymeric seals that contact the isotropically finished surface of the steel bushing and an inside surface of the bore of at least one of the adjacent track links.

18. The track of claim 17, wherein the compound layer is formed by at least one of nitriding and ferritic nitrocarburizing.

19. The track of claim 17, wherein the surface further includes a physical vapor deposition layer of at least one of chrome nitride, metal containing diamond-like carbon, amorphous diamond-like carbon, TiCN, and TiBN.

20. The track of claim 17, wherein the isotropically finished surface has a surface roughness of $Ra \leqq 0.1\ \mu m$.

21. The track of claim 17, wherein the isotropically finished surface has a surface roughness of $Ra \leqq 0.05\ \mu m$.

* * * * *